US006651559B2

(12) United States Patent
Haraux et al.

(10) Patent No.: US 6,651,559 B2
(45) Date of Patent: Nov. 25, 2003

(54) BLANKET WITH VARIABLE SURFACE PROPERTIES FOR A PRINTING MACHINE

(75) Inventors: Sophie Haraux, Thann (FR); Chouaib Boukaftane, Mulhouse (FR); Jerzy Kuczynski, Zillisheim (FR); Khalid Zahouily, Lutterbach (FR); Christian Decker, Rixheim (FR)

(73) Assignee: MacDermid Graphic Arts SA (FR)

( * ) Notice: Subject to any disclaimer, the term of this patent is extended or adjusted under 35 U.S.C. 154(b) by 0 days.

(21) Appl. No.: 09/499,330

(22) Filed: Feb. 4, 2000

(65) Prior Publication Data

US 2003/0150346 A1 Aug. 14, 2003

(30) Foreign Application Priority Data

Feb. 4, 1999 (FR) ..... 99 01309

(51) Int. Cl.[7] ..... B41F 13/10
(52) U.S. Cl. ..... 101/376; 428/909
(58) Field of Search ..... 101/376, 177, 101/181, 183, 216, 217, 228, 232, 375, 401.1; 428/909

(56) References Cited

U.S. PATENT DOCUMENTS

| | | | | |
|---|---|---|---|---|
| 1,528,660 A | | 3/1925 | De'Sperai | |
| 4,172,772 A | * | 10/1979 | Ould et al. | 205/153 |
| 5,522,315 A | * | 6/1996 | Behnke et al. | 101/376 |
| 5,554,712 A | * | 9/1996 | Huynh-Tran et al. | 430/284.1 |
| 5,677,110 A | * | 10/1997 | Chia et al. | 430/273.1 |
| 6,027,789 A | | 2/2000 | Canet et al. | |
| 6,105,498 A | * | 8/2000 | Vrotacoe et al. | 101/376 |

FOREIGN PATENT DOCUMENTS

| | | |
|---|---|---|
| CA | 2005875 | 6/1990 |
| DE | 444124 C | 5/1927 |
| DE | 2452752 A | 5/1976 |
| DE | 2660483 B | 7/1981 |
| DE | 4436973 A | 6/1995 |
| EP | 0806304 A | 11/1997 |

* cited by examiner

*Primary Examiner*—Ren Yan
(74) *Attorney, Agent, or Firm*—Carmody & Torrance LLP

(57) ABSTRACT

The invention concerns a printing blanket for a cylinder of a printing machine, specifically of offset type, including a ground or polished or even molded lithographic layer, at least one reinforcing layer and at least one compressible layer. According to the invention, at least one surface property of the invention, namely the overall surface energy of the blanket, the surface energy with a polar character of the blanket or the average roughness of the blanket varies on the outer surface of the blanket crosswise. The invention is applicable for any indirect printing process, especially offset printing as function.

12 Claims, 2 Drawing Sheets

BLANKET WITH VARIABLE SURFACE PROPERTIES FOR A PRINTING MACHINE

FIELD OF THE INVENTION

The invention concerns a blanket for a printing machine with variable surface properties.

BACKGROUND OF THE INVENTION

The blanket of the invention is more particularly designed for machines permitting putting into operation a printing process in a indirect manner, that is to say, with an intermediate transfer element. One can namely point to machines which permit putting into operation an offset, indirect heliography type process, or an indirect digital printing process with solid or liquid toner.

First of all, printing color images is generally obtained by superposition of at least four primary colors (cyan, magenta, yellow and black). These four primary colors are successively printed in printing groups distant from one another. This distance between groups can generate deviations for the trajectory of the band of paper to be printed as well as deformations in this band. Thus, deviations in positioning the various primary colors affect the quality of the printed image.

On the rotary printing presses serving to print newspapers, the phenomenon called "fan-out" appears which manifests itself by stretching the paper between different printing groups and therefore by a loss of registers for the four color printers.

On sleeve presses which are wider than the rotary printing presses of the older generation, one likewise notes phenomena of broadening or shrinkage of the dimensions effectively printed by each group. These phenomena have as a result a loss of lateral register on the edge of the printed span.

These printing errors become even more visible with an increase in the width of the printing machine and the printing speed.

One can likewise note inconveniences more particularly associated with the offset printing process.

In offset printing, the printing cylinders are lined with a blanket which ink borne by an offset plate, itself borne by a cylinder which was previously covered by a film of ink and water. The blanket-bearing cylinder conducts the printing on a band of paper, for example, which is held by a counter pressure cylinder.

Thus, the offset printing process is characterized by the presence of moistening water and by the high viscosity of the inks.

Upon leaving printing, that it at the level of the zone of contact between the blanket-bearing cylinder and the counter pressure cylinder (commonly called the "printing nip zone"), high separation stresses are generated which induce a poor relaxation of the paper by reason of an excessive relative adherence between the ink and the surface of the blanket.

This traction exerted on the paper has the tendency, on wide machines, to deform it in the shape of a paper hat which induces register defects.

Moreover, from the fact of this relatively significant adherence, fibers can be detached from the band of paper and will accumulate on the blanket itself, which is of a nature to cause printing quality to deteriorate progressively.

Otherwise, the moistening water assures the segregation of printing zones and no-printing zones and allows balancing the offset printing process. Nonetheless, the presence of water can deform the paper or at least alter its mechanical characteristics. This can likewise entail register defects between the different printing groups.

Some solutions have already been proposed within the state of the art to resolve these problems.

One can in particular cite the document EP-0 659 585 which describes a blanket presenting, by its construction, a concave or convex profile. This profile is designed to eliminate deviations in surface scrolling speed on the direction across the band of paper to avoid thus the appearance of possible folds.

Nevertheless, such a blanket leads to the appearance of different pressures in the direction of the width of the blanket which can cause printing defects, namely a diminution of printing contrast values.

One can likewise cite document WO 95/23706 which describes compressible layer blankets presenting a central region of greater compressibility than the peripheral parts.

For this, the compressible layer can present a parabolic profile, the variation in thickness of this layer leading to a variation in compressibility.

Such a blanket has for its object guaranteeing a better holding of the registers.

Nevertheless, it has been possible to confirm that the sleeves proposed by the state of the art do not permit complete resolution of the problem of printing defects.

In fact, the solutions proposed by the state of the art only take into consideration the mechanical characteristics of the printing process, such as the pressure in the contact zone between the two cylinders or the width of the cylinder.

Thus, a practically non-measurable deformation, for example, a deformation of 0.005% of the paper on a span of 2000 mm suffices to create a lateral register defect of 50 $\mu$m at the extremities. This defect is redhibitory in terms of quality.

SUMMARY OF INVENTION

Within the framework of the invention, it has been shown that the surface properties of the blankets have a significant influence on the quality of transfer during printing which specifically depends upon printing clearance, the quality of the flat tints, the relaxation of the paper, the transfer of moistening water the paper, paper flow or even the holding of the registers.

Thus, the surface properties of the blanket exert an influence on the separation of the ink film specifically upon leaving the printing nip while more or less facilitating the relaxation of the band of paper. The surface properties thus exert an influence on the deformation of the entirety of the band of paper if these surface properties are variable in a crosswise direction.

Likewise, a variation of the surface properties of the blanket can induce a variation in the quantity of moistening water transmitted to the paper and thus modify the level of mechanical deformation of the entirety of this during the printing process.

The invention therefore has as its purpose palliating the inconveniences known in the state of the art by proposing a printing blanket permitting optimizing the quality of printing taking into consideration the surface properties of the blanket.

Thus, the invention relates to a printing blanket for a printing machine cylinder, specifically of offset type, including a rectified or polished, or even molded lithographic layer, at least one reinforcing or support layer and at least one compressible layer, characterized in that at least one surface property of the blanket, namely the overall surface energy of the blanket, the surface energy with polar character or the mean roughness of the blanket, varies on the outer surface of the blanket in a crosswise direction.

The definition of surface energy with a polar character constitutes at the same time indiscriminately a means for measuring acid-basic type interactions and amphoteric type interactions of the surface of the blanket with the moistening water and the ink.

Preferably, this surface property is constant in the circumferential direction of the blanket.

Otherwise, this surface property of the blanket varies advantageously in a symmetrical manner in relation to the median transversal plane of the blanket.

By way of example, this surface property of the blanket varies from one edge of the blanket to a transversal plane, and in the transverse direction in a discontinuous manner, specifically by discrete increments, or continuously, namely in a linear manner or according to a parabolic, cubic or sigmoid type of profile.

Moreover, this surface property of the blanket can increase or decrease from one edge of the blanket to the transversal plane in the transverse direction.

In one embodiment of the printing blanket of the invention, when a blanket is installed on the cylinder of the printing machine, its outer surface is perceptible cylindrical.

In another embodiment, when the blanket is installed on the cylinder of the printing machine, the outer surface of the blanket presents a concave or convex contour.

Moreover, the compressible layer of the printing blanket of the invention advantageously has a variable compressibility in the crosswise direction.

Preferably, the overall surface energy of the printing blanket of the invention varies between two extreme boundaries each falling between 5 and 50 $mJ/m^2$, and advantageously between 10 and 30 $mJ/m^2$.

Likewise preferably, the surface energy with a polar character of the printing blanket of the invention varies between two extreme boundaries each comprised between 0 and 25 $mJ/m^2$.

This polar component of surface energy measures an acidic, basic or amphoteric character of the surface of the blanket on a case by case basis.

Finally, the average roughness of the printing blanket of the invention preferably between two extreme limits each falling between 0.3 $\mu$m and 2 $\mu$m.

The invention likewise concerns a process for creating a printing blanket according to the invention.

This process consists in photochemically grafting some monomers on the outer surface of a blanket including a ground or polished or even molded lithographic layer, at least one reinforcement or support layer, and at least one compressible layer, the density of the grafting being variable according to the crosswise direction of the blanket such that at least one surface property of the blanket, namely the overall surface energy or the surface energy with a polar character of the blanket, likewise varies in the cross wise direction.

The process of the invention can likewise consist of conducting, on the outer surface of a blanket including a ground or polished or even molded lithographic layer, at least one reinforcement or support layer and at least one compressible layer, a chemical treatment, by ionization or even by heating, specifically of flame type, this process being conducted in a variable manner in the crosswise direction of the blanket such that at least one surface property of the blanket, specifically the overall surface energy of the blanket, likewise varies in the crosswise direction.

The process of the invention can even consist of mechanical processing, for example, abrading or machining, especially by laser, of the outer surface of a blanket including a ground or polished, or even molded lithographic layer, at least one reinforcement or support layer, and at least one compressible layer, this treatment being conducted in a variable manner in the crosswise direction of the blanket such that at least one property of the blanket, namely its average roughness, likewise varies crosswise.

The process of the invention likewise consists of manufacturing a blanket including a lithographic layer, at least one reinforcement or support layer and at least one compressible layer, the lithographic layer being obtained by molding and the outer surface of the blanket presenting an average roughness which is variable in the crosswise direction of the blanket, obtained directly by molding.

The invention will be better understood, and other purposes, advantages and characteristics of it will become more clearly apparent upon reading the description below which will be conducted specifically with regard to the appended drawings.

Figure 1:
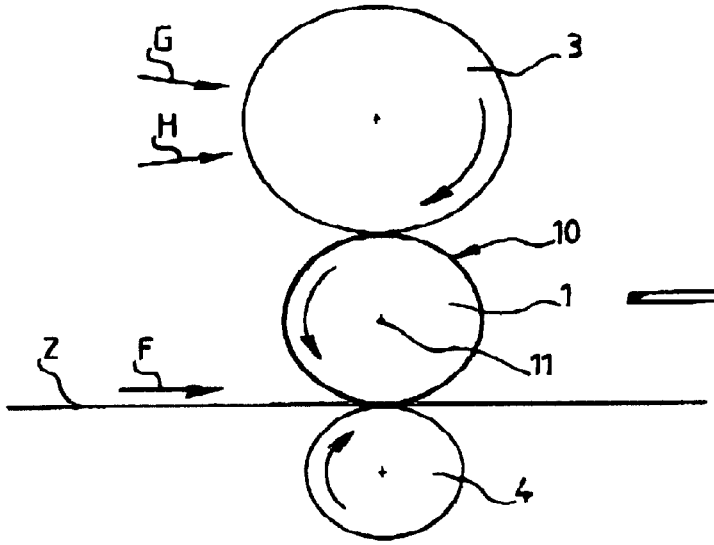
FIG. 1 is a schematic view in elevation of a part of a printing machine of offset type using a printing cylinder bearing a blanket of the invention.

Reference is made first of all to FIG. 1 which illustrates a printing cylinder 1 on which a blanket 10 of the invention is mounted. This blanket includes a ground or polished or even molded lithographic layer, at least a reinforcement or support layer and at least a compressible layer. The details of these differences are not illustrated on FIG. 1.

DETAILED DESCRIPTION OF THE INVENTION

The lithographic layer of this blanket 10 is such that at least one surface property varies on its outer surface in the crosswise direction, that is to say in a direction perpendicular to the direction of scrolling of the paper 2 which is illustrated by the arrow F and parallel to the axis of rotation of the cylinder 1.

FIG. 1 likewise illustrates a plate-bearing offset cylinder 3 receiving the moistening water and the ink as this is visualized by the arrows G and H.

The water and ink are transferred upon the printing cylinder under the action or rotation. The cylinder 1 makes an impression on the sheet of paper 2 which is held by a counter pressure cylinder 4 or a second printing cylinder identical to cylinder 1 bearing a printing blanket on the back of the sheet of paper 2.

As previously indicated, it has been shown that the properties of the surface of the blanket strongly influence the transfer of ink on the printing cylinder as well as the separation from the film of ink at the level of the zone of contact between the printing cylinder and the counter pressure cylinder. These surface properties likewise influence the quantity of moistening water necessary for the stability of the offset printing process and the quantity of water transferred to the paper in this contact zone.

The surface properties which exert an influence on the quality of printing are namely the overall surface energy of the blanket, the surface energy with a polar character and the average roughness of the blanket.

As a function of the type of machine and the application involved, it is thus desirable to have at least one of the surface properties vary in the crosswise direction of the blanket to optimize the quality of impression.

It is quite possible only to modify a single surface property in the crosswise direction of the blanket, or even combine variations of several surface properties, always as a function of the application envisaged.

In this regard, it is appropriate to note that the invention which is based on a variation of one or several surface properties of the blanket of the invention runs counter to the preconceived opinions of the specialist.

In fact, for him a printing blanket necessarily has constant properties. One will recall that a blanket is manufactured continuously in a classical manner, then cut, and the manufacturing techniques do not permit generating variations of surface properties in a specific direction.

The overall surface energy and the surface energy with a polar character of the blanket can namely be modified to be variable in the transverse direction of the blanket by photochemically grafting anti-adherent, hydrophilic or hydrophobic monomers or oligomers onto the outer surface of the blanket.

Such a process of photochemical grafting is namely described in document EP-0 806 304 to which one may refer.

This grafting procedure is implemented on the substrate constituting the exterior surface of the blanket. This substrate can be constituted by a nitrile-based elastomer material which is ground and abraded or obtained by extrusion. This substrate can likewise be realized in a hydrophobic material such as a polyolefin elastomer or in a hydrophilic material such as a carboxylated nitrile-based elastomer.

For example, one can have the overall surface energy of the blanket of the invention vary in the crosswise direction, grafting on its outer surface monomers which impart a hydrophobic character to the substrate after grafting.

One can namely cite non-polar monomers, such as alkane, alkene or fluorinated monomers with, for example, one or more acrylate or methacrylate functions.

In the parts of the blanket of the invention where the monomers are grafted, the overall surface energy of the blanket is weaker or higher than in the substrate zones which do not bear such grafted monomers according to the chemical nature of these monomers.

In these grafted zones, the water and ink present on the blanket will be more easily loosened and the transfer of the ink from the blanket 1-bearing cylinder to the sheet of paper will be facilitated.

One can likewise envisage grafting some silicon-based monomers on the substrate by implementing the process described in document EP-0 806 304.

The blanket zones having grafted silicon-based monomers have a weaker overall energy than the non-grafted zones.

Thus, in these grafted zones, the transfer of the ink from the printing cylinder 1 on the sheet of paper 2 is facilitated.

What is more, these grafted silicon-based monomers have an anti-adhesive or relaxing power. Thus, when the paper 2 leaves the gap between cylinders 1 and 4, the separation of the ink film is conducted more easily.

The surface energy with a polar character can likewise be modified according to the crosswise direction of the blanket of the invention while grafting monomers on the substrate which impart a hydrophilic character to it after grafting.

The grafting can likewise be realized according to the process described in document EP-0 806 304. These monomers are, for example, monomers including acid, alcohol or amide functions, such as acrylic acid or methacrylic acid.

Grafting these monomers allows attracting water from the cylinder 3 onto the printing cylinder 1 and reestablishing the balance between water and ink.

The nature of the monomer or oligomer, or monomers or oligomers including, for example, acid, alcohol or amide functions, confers an acid, basic or even amphoteric character to the grafted substrate in the crosswise direction of the blanket.

Generally, the photochemical grafting of a monomer onto the substrate is realized, following smearing the monomer on the substrate, by irradiation of this through a mask with opaque and transparent parts.

The substrate can be irradiated with the aid of a high energy ultraviolet irradiation or even with the aid of visible light, a bundle of electrons or even an X ray.

Otherwise, to obtain a suitable variation in the crosswise direction of the blanket of a surface property of it, the mask used in the grafting procedure presents a different optical density in the crosswise direction of the sleeve, or even a variable distribution of the opaque and transparent parts in this transverse direction.

This distribution generates the sizes of discrete zones having different surface properties from those of the substrate, variable according to the location on the surface of the blanket. This distribution can likewise generate a variable spacing of discrete zones having different surface properties from those of the substrate according to its location on the surface of the blanket.

In order to have several surface properties of the blanket vary, and namely at the same time the overall surface energy and the surface energy with a polar character of the blanket, the grafting procedure which is the object of document EP-0 806 304 can be implemented several times in successive manner on the same substrate, as this is otherwise moreover described in this document.

One may in addition note that the variation of the properties of the surface of the blanket, namely its overall surface energy and its surface energy with a polar character, can be obtained by processes other than the one described in document EP-0 806 304.

One can in particular point to a chemical treatment, an ionization treatment or a flame treatment.

An ionization or flame treatment of the substrate of the blanket both have as their purpose to oxidize the surface of the substrate in the zones concerned and to increase the surface energy of the blanket. This namely has as a consequence that the ink spreads more easily on the printing cylinder 1.

One can likewise obtain variations in the properties of the surface of the blanket in the transverse direction, and particularly a variation in average roughness by mechanical treatments.

Thus, the average roughness of the outer surface of the blanket 1 can be made variable in the crosswise direction of the blanket by undertaking a final abrasion or a laser machining of the outer surface of the blanket in an appropriate manner.

A variation of the average roughness of the outer surface of the blanket in the transverse direction can also be obtained directly by molding when the blanket of the invention is obtained with a mold having an appropriate surface finish.

A variation of average roughness can likewise be obtained by a hot calendering type process.

In the blanket zones having a greater roughness than the others, catching water on the blanket is facilitated even if the substrate is hydrophobic.

Otherwise, in these same zones, a thick film of water and of ink has the tendency to arise which facilitates the separation of films of water and ink and thus contributes to the quality of printing on the sheet of paper 2.

It is evident that the procedures just described can be implemented successively on the same substrate such as to combine variations of different surface properties of the blanket.

Reference is now made to FIGS. 2 to 7 which illustrate examples of variation of a surface properties of the blanket in the transverse direction.

Thus, each of FIGS. 2 to 7 is a diagram illustrating the variation of a surface property of the blanket (PSB in the ordinates) as a function of the position of a point in the crosswise direction of the blanket or the span (L on the abscissae). X corresponds to the breadth of the blanket.

On all the FIGS. 2 to 7, the variation in the surface property of the blanket is symmetrical in relation to the median transversal plane of the blanket, plane which is schematized by the straight line M.

Nonetheless, the blanket of the invention is not limited to this type of centered variation.

Figure 2:
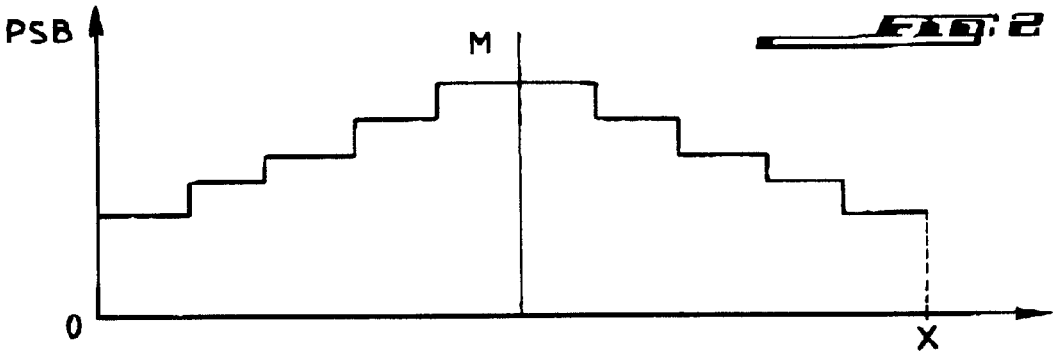
FIGS. 2 to 7 represent different modes of variation of a surface property of the blanket in a crosswise direction.

As FIG. 2 illustrates, the surface property of the blanket can vary from one edge of the blanket to the other in a discontinuous manner, and for example by discrete increments.

On FIG. 2, the surface property of the blanket increases from one edge of the blanket up to the central transversal or median plane of the blanket, then decreases up to the other edge of the blanket.

This variation of the surface property of the blanket thus defines a profile called "positive."

As FIGS. 3 to 7 illustrates, the variation in the surface property of the blanket can also be continuous.

Figure 3:
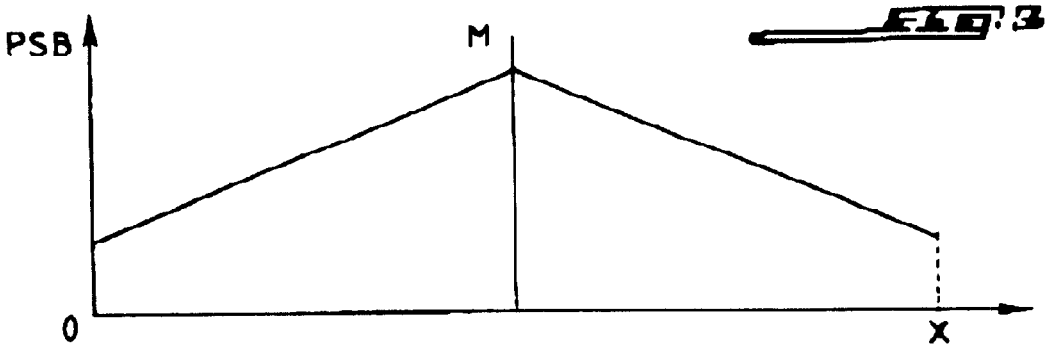

On FIG. 3, this variation is linear, and likewise defines a "positive" profile.

Figure 4:
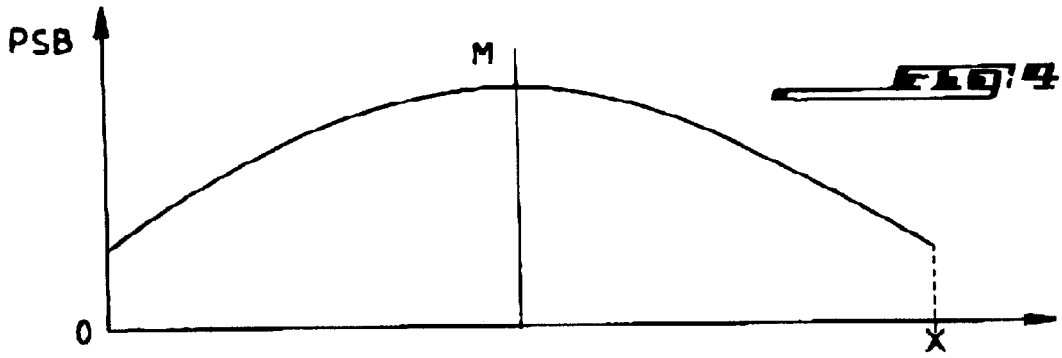

On FIG. 4, this variation defines a parabolic profile which is likewise "positive."

Figure 5:
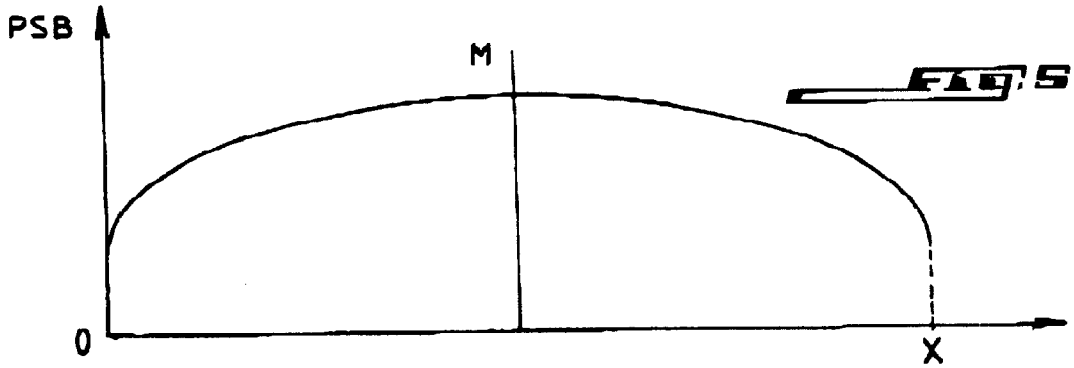
Figure 6:
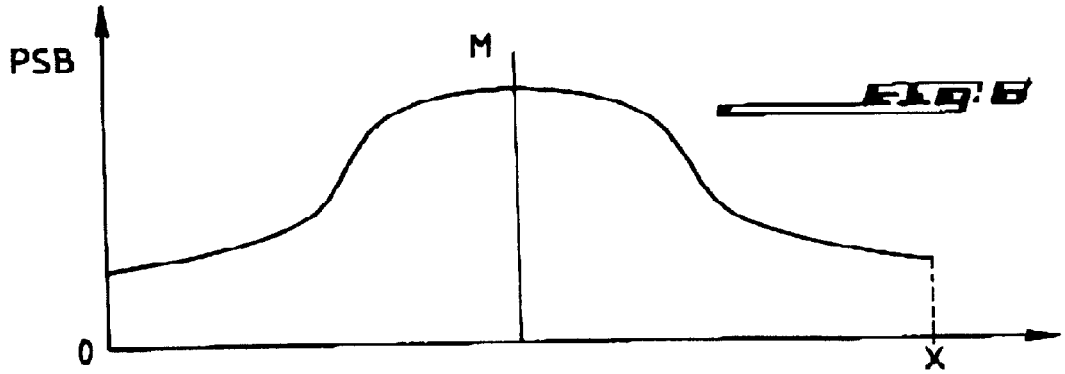

FIG. 5 illustrates a variation of the surface property of the blanket which is brought about according to a cubic profile, while FIG. 6 shows a variation of the surface property occurring according to a sigmoid property. These two profiles are likewise "positive."

Figure 7:
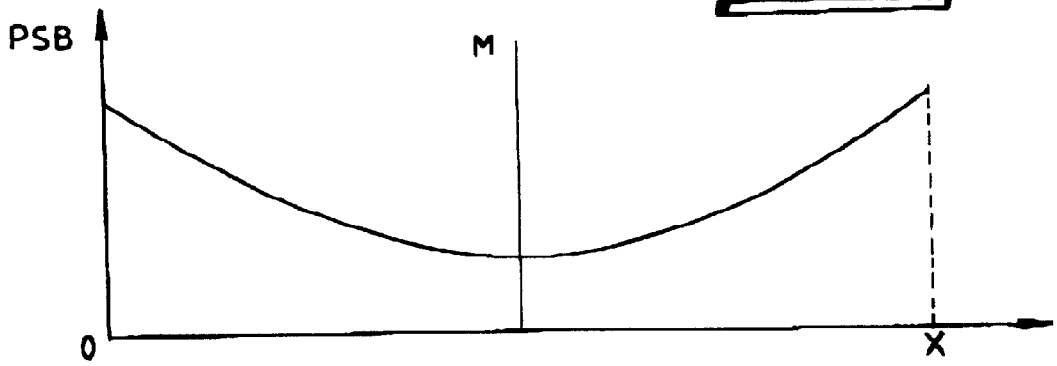

Finally, FIG. 7 defines a variation of a surface property of the blanket which is continuous from one edge of the blanket to the other, symmetrical in relation to the transversal median plane which defines a parabolic profile.

Nonetheless, in contrast with FIG. 4, the surface property diminishes from one edge of the extremity of the blanket toward the median transversal plane and increases from this plane toward the other edge of the extremity of the blanket.

This surface property thus varies according to a "negative" profile.

It is obvious that the examples of variation of the surface property which have been described in reference to FIGS. 2 to 6 could equally define a negative profile.

As indicated previously, the surface properties of the blanket which one allows to vary and their profile of variation are chosen as a function of the application envisioned.

Nevertheless, these variations should be conducted within certain limits.

In particular, the overall surface energy of the blanket varies, preferably, between two extreme limits each falling between 5 and 50 $mJ/m^2$, and advantageously between 10 and 30 $mJ/m^2$.

The surface energy with a polar character of the blanket according to the invention varies, preferably, between two extreme limits each falling between 0 and 25 $mJ/m^2$.

Finally, the average roughness of the outer surface of the blanket of the invention varies, preferably, between two extreme limits each falling between 0.3 and 0.8 $\mu$m and between 0.8 and 2 $\mu$m according to the printing quality desired.

As indicated previously, one can have one or more surface properties of the blanket in the crosswise direction between two predefined extreme limits using, for example, the variation profiles which have been described above in reference to FIGS. 2 to 7.

Generally, the surface properties of the blankets are constant in the direction of scrolling of the paper, or circumferential direction, but this is not obligatory.

Otherwise, the outer surface of the blanket of the invention, installed on the cylinder of the printing machine, can be perceptibly cylindrical.

Nonetheless, this outer surface of the blanket, installed on the cylinder of the printing machine, can likewise present a particular geometrical profile such as a concave or convex profile as this is described in document EP-0 659 585 to which one may refer.

Thus, the blanket of the invention can have one or more variable surface properties in the crosswise direction, these variable surface properties being combined with a profile specifically permitting avoiding the appearance of possible folds or register defects.

One can likewise envision a blanket of the invention including a compressible layer, the compressibility of which is variable crosswise, such as is described in document WO 95/23706 to which one may refer.

The preceding description has basically been made in relation to an offset printing process. As has already been indicated, the blanket of the invention can be used in any indirect printing process, such as indirect heliography and indirect digital printing.

The blankets of the invention can equally assume the form of plates or enameling sleeves.

Finally, in the entire description, reference is made to a printing blanket. It is obvious that the term blanket covers at one and the same time indiscriminately a blanket designed to be fixed in a printing cylinder with a gap, a blanket designed to be cemented on the outer surface of a cylinder and a continuous printing sleeve.

The blanket is installed or fixed on the printing cylinder by a system of tightening in the gap, by gluing or by sleeving with any inherently known means.

The invention is not limited to the embodiments which have been described. On the contrary, it includes all the technical equivalents of the means described as well as their combinations if these enter into the framework of the appended claims.

What is claimed is:

1. A printing blanket for mounting on a cylinder of a printing machine comprising an outer lithographic layer, at least one support layer and at least one compressible layer, the outer surface of the lithographic layer comprising monomers grafted thereto, wherein the monomers are adapted such that density of the grafting varies in the crosswise direction of the blanket such that at least one surface property of the blanket selected from the group consisting of the overall surface energy and the surface energy with a polar character is variable cross-wise, and wherein said variation in surface property is symmetrical in relation to the median transversal plane of the blanket.

2. The printing blanket of claim 1 wherein the outer surface of the blanket has a concave profile when mounted on a cylinder.

3. The printing blanket of claim 1 wherein the outer surface of the blanket has a convex profile when mounted on a cylinder.

4. The printing blanket of claim 1 wherein the variation is intermittent.

5. The printing blanket of claim 1 wherein said variation in surface property is linear from an edge of the blanket.

6. The printing blanket of claim 1 wherein said variation in surface property is parabolic from an edge of the blanket.

7. The printing blanket of claim 1 wherein said variation in surface property is cubic from an edge of the blanket.

8. The printing blanket of claim 1 wherein said variation in surface property is sigmoid from an edge of the blanket.

9. The printing blanket of claim 1 wherein the overall surface energy varies between 5 and 50 $mJ/m^2$.

10. The printing blanket of claim 9 wherein the overall surface energy varies between 10 and 30 $mJ/m^2$.

11. The printing blanket of claim 1 wherein the surface energy with a polar character varies between 0 and 25 $mJ/m^2$.

12. The printing blanket of claim 1, wherein said monomers are photochemically grafted onto said outer surface of the lithographic layer by smearing said monomers on said outer surface of said lithographic layer and irradiating said monomers through a mask, and wherein said mask comprises opaque and transparent parts.

* * * * *